US011131962B2

(12) United States Patent
Kim

(10) Patent No.: US 11,131,962 B2
(45) Date of Patent: Sep. 28, 2021

(54) GUIDE MEMBER FOR MOUNTING A CONSUMABLE CARTRIDGE ON A TRAY

(71) Applicant: HEWLETT-PACKARD DEVELOPMENT COMPANY, L.P., Spring, TX (US)

(72) Inventor: Young Hoon Kim, Suwon-Si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/963,741

(22) PCT Filed: May 14, 2018

(86) PCT No.: PCT/KR2018/005485
§ 371 (c)(1),
(2) Date: Jul. 21, 2020

(87) PCT Pub. No.: WO2019/142974
PCT Pub. Date: Jul. 25, 2019

(65) Prior Publication Data

US 2021/0096505 A1 Apr. 1, 2021

(30) Foreign Application Priority Data

Jan. 22, 2018 (KR) ..... 10-2018-0007920

(51) Int. Cl.
*G03G 21/00* (2006.01)
*G03G 21/18* (2006.01)
*G03G 15/08* (2006.01)

(52) U.S. Cl.
CPC ..... *G03G 21/1842* (2013.01); *G03G 21/1853* (2013.01); *G03G 21/1864* (2013.01); *G03G 15/0875* (2013.01); *G03G 2221/1869* (2013.01)

(58) Field of Classification Search
CPC ..... G03G 21/1842; G03G 21/1853; G03G 21/1864; G03G 2221/1684; G03G 2221/1869
USPC ..... 399/112
See application file for complete search history.

(56) References Cited

U.S. PATENT DOCUMENTS

2008/0138115 A1* 6/2008 Chadani ..... G03G 21/1839 399/167
2008/0292355 A1 11/2008 Sakurai et al.
2010/0239314 A1 9/2010 Takayama
2011/0116833 A1* 5/2011 Maeda ..... G03G 21/1867 399/112

(Continued)

FOREIGN PATENT DOCUMENTS

JP 10-221919 8/1998
JP 2013-97185 5/2013
KR 10-2013-0129847 11/2013

*Primary Examiner* — Robert B Beatty
(74) *Attorney, Agent, or Firm* — Staas & Halsey, LLP

(57) ABSTRACT

An image forming apparatus includes a main body, and a tray movable from an inner portion of a main body to outside of the main body. A plurality of consumable cartridges are removably mountable on the tray. The tray includes a guide member, and during mounting of each of the plurality of consumable cartridges, the guide member moves each of the plurality of consumable cartridges in a direction perpendicular to a mounting direction of the consumable cartridges so that the consumable cartridges are mounted on the tray.

19 Claims, 13 Drawing Sheets

(56) References Cited

U.S. PATENT DOCUMENTS

| | | | | |
|---|---|---|---|---|
| 2014/0294439 | A1* | 10/2014 | Kawahara | G03G 21/1623 399/119 |
| 2016/0231697 | A1* | 8/2016 | Sato | G03G 21/1842 |
| 2016/0231702 | A1* | 8/2016 | Sato | G03G 21/1842 |
| 2017/0308031 | A1 | 10/2017 | Okabe | |
| 2018/0329363 | A1* | 11/2018 | Hijikata | G03G 21/1817 |
| 2019/0302674 | A1* | 10/2019 | Wang | G03G 21/1619 |

* cited by examiner

[Fig. 1]
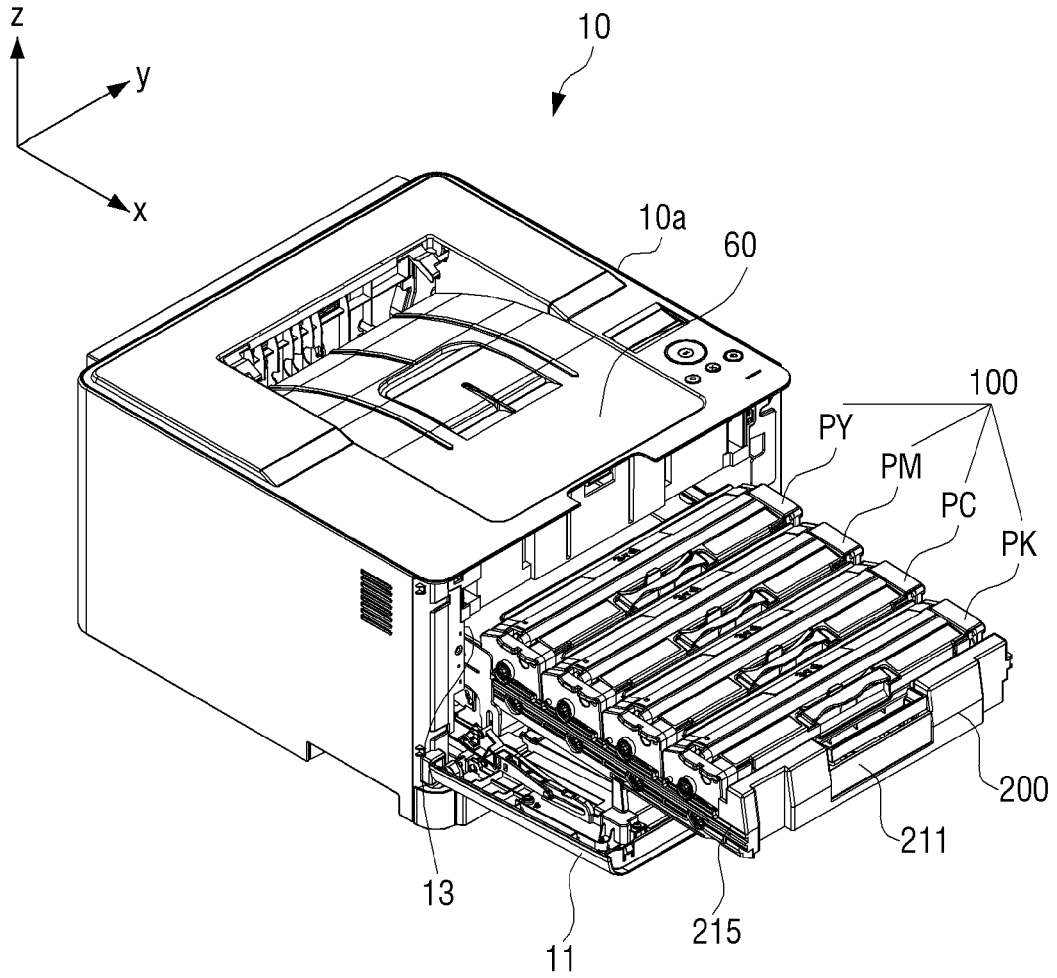

[Fig. 2]
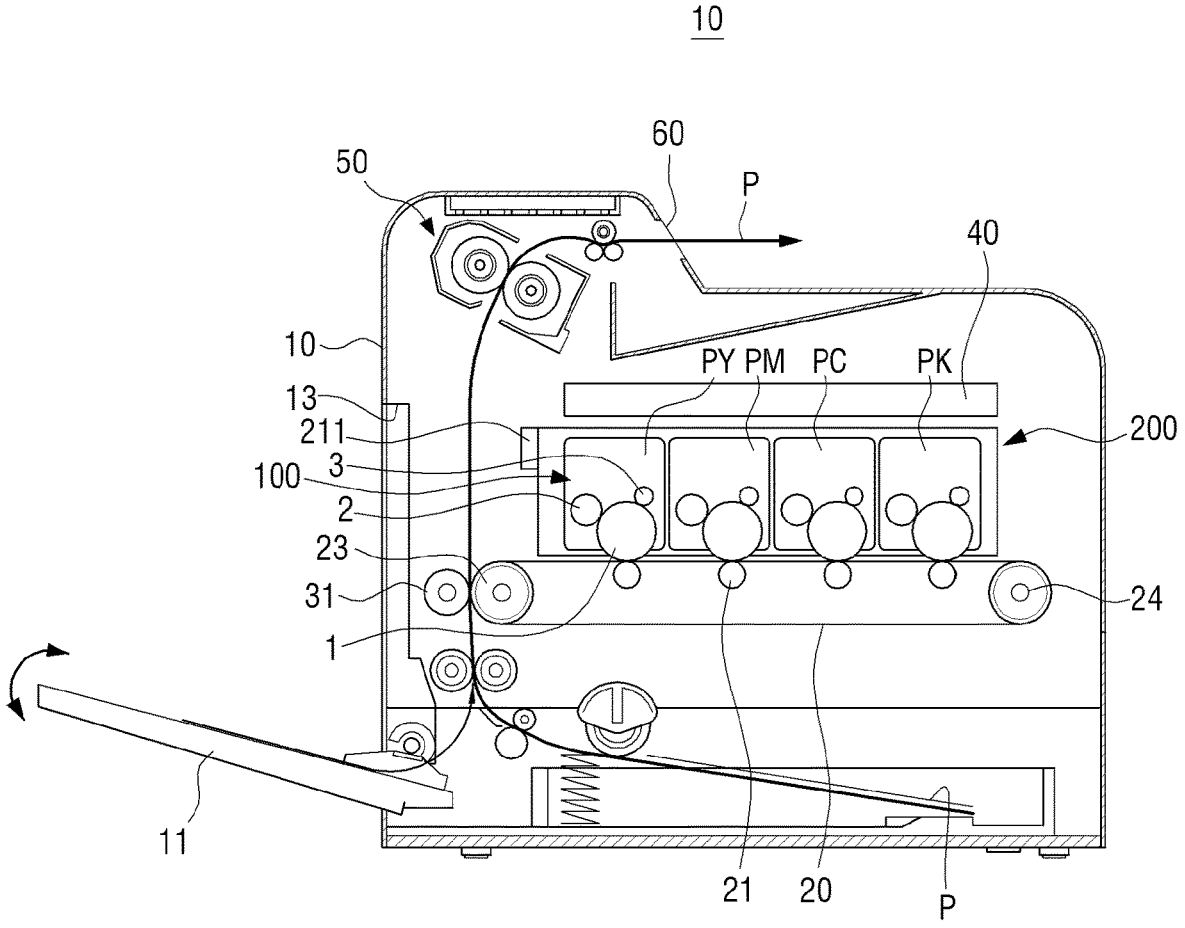

[Fig. 3]
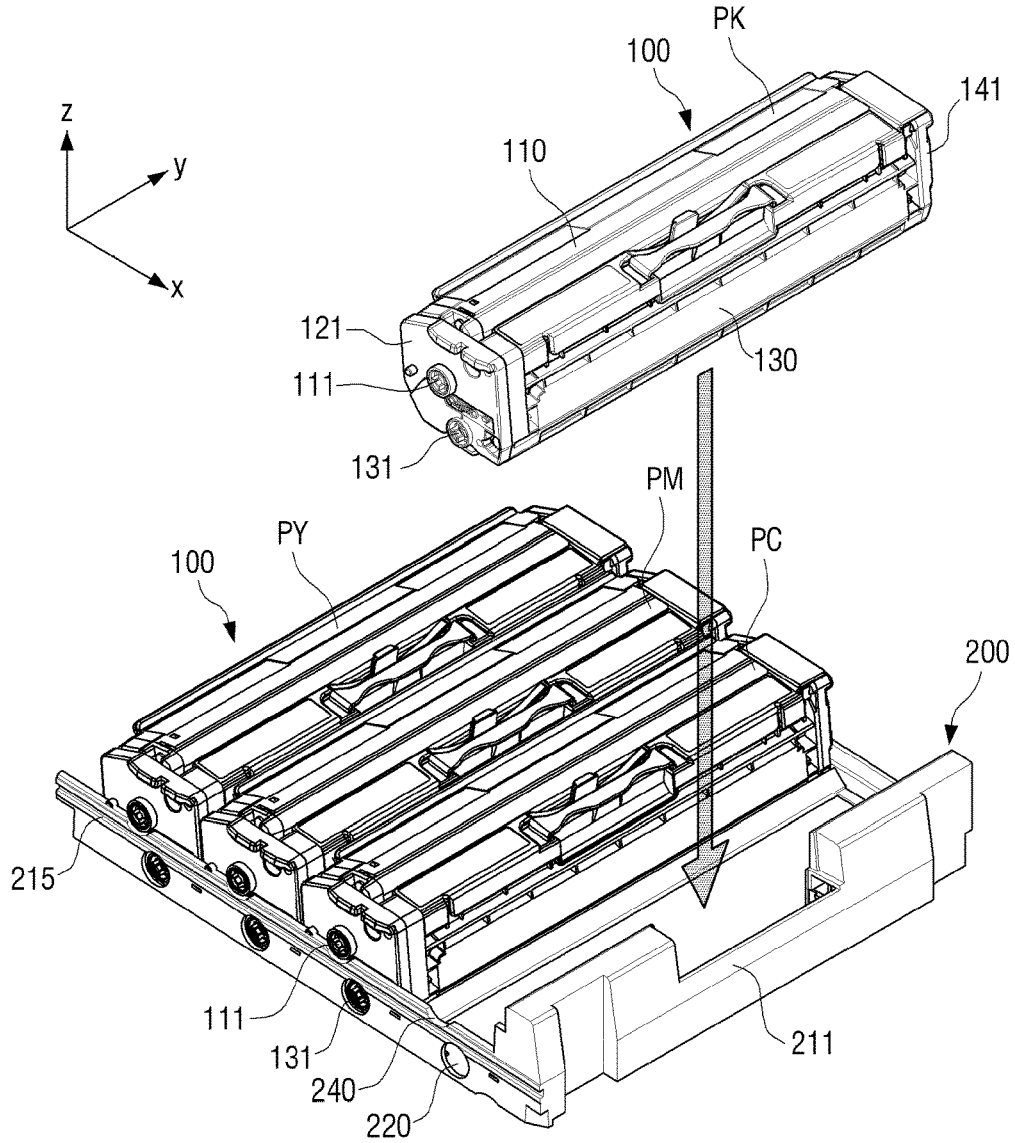
[Fig. 4]
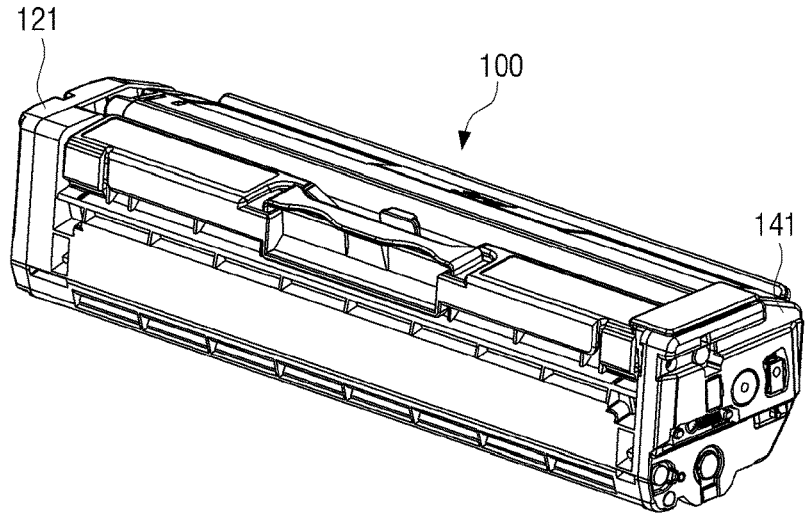

[Fig. 5]
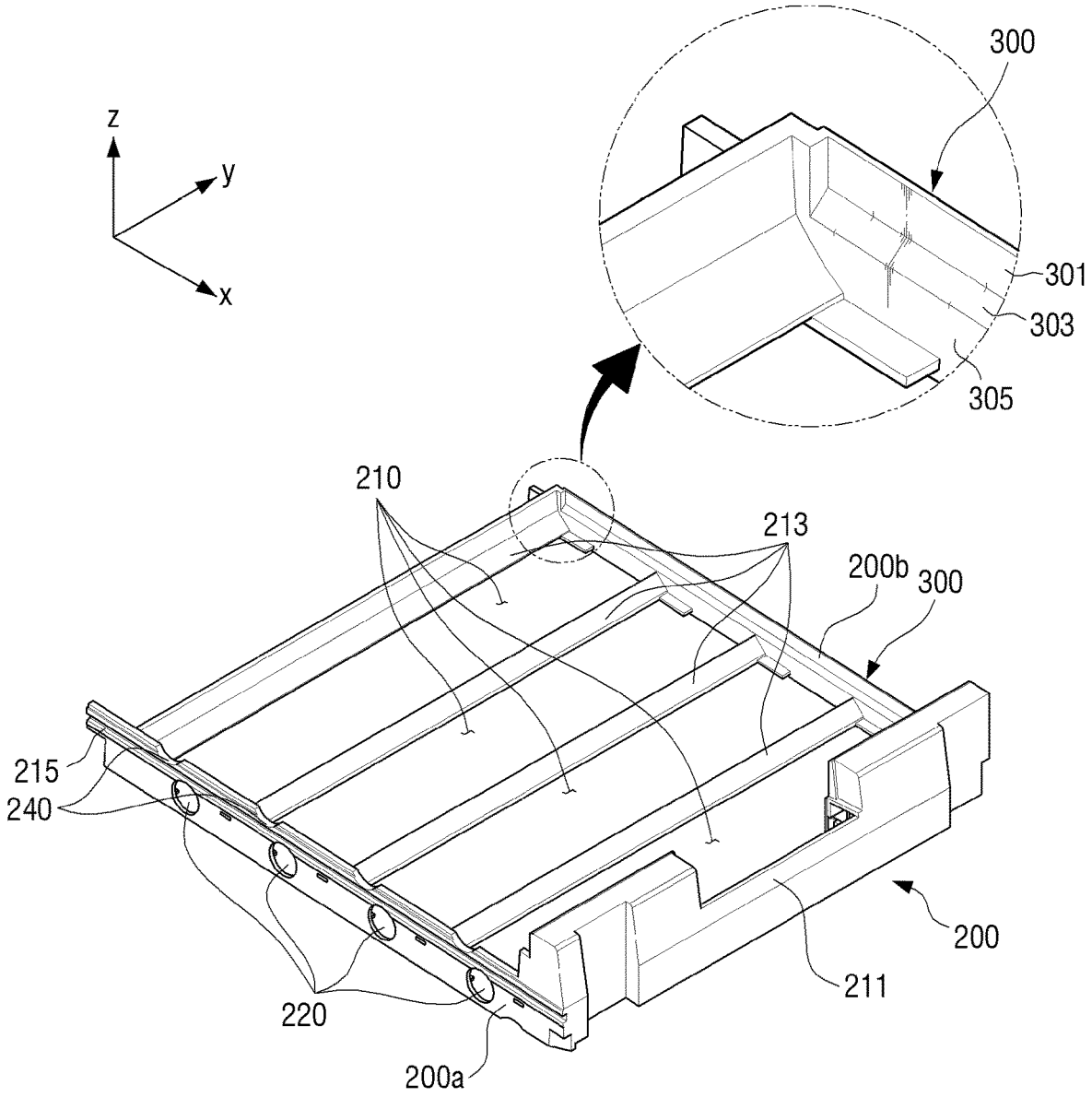

[Fig. 6a]
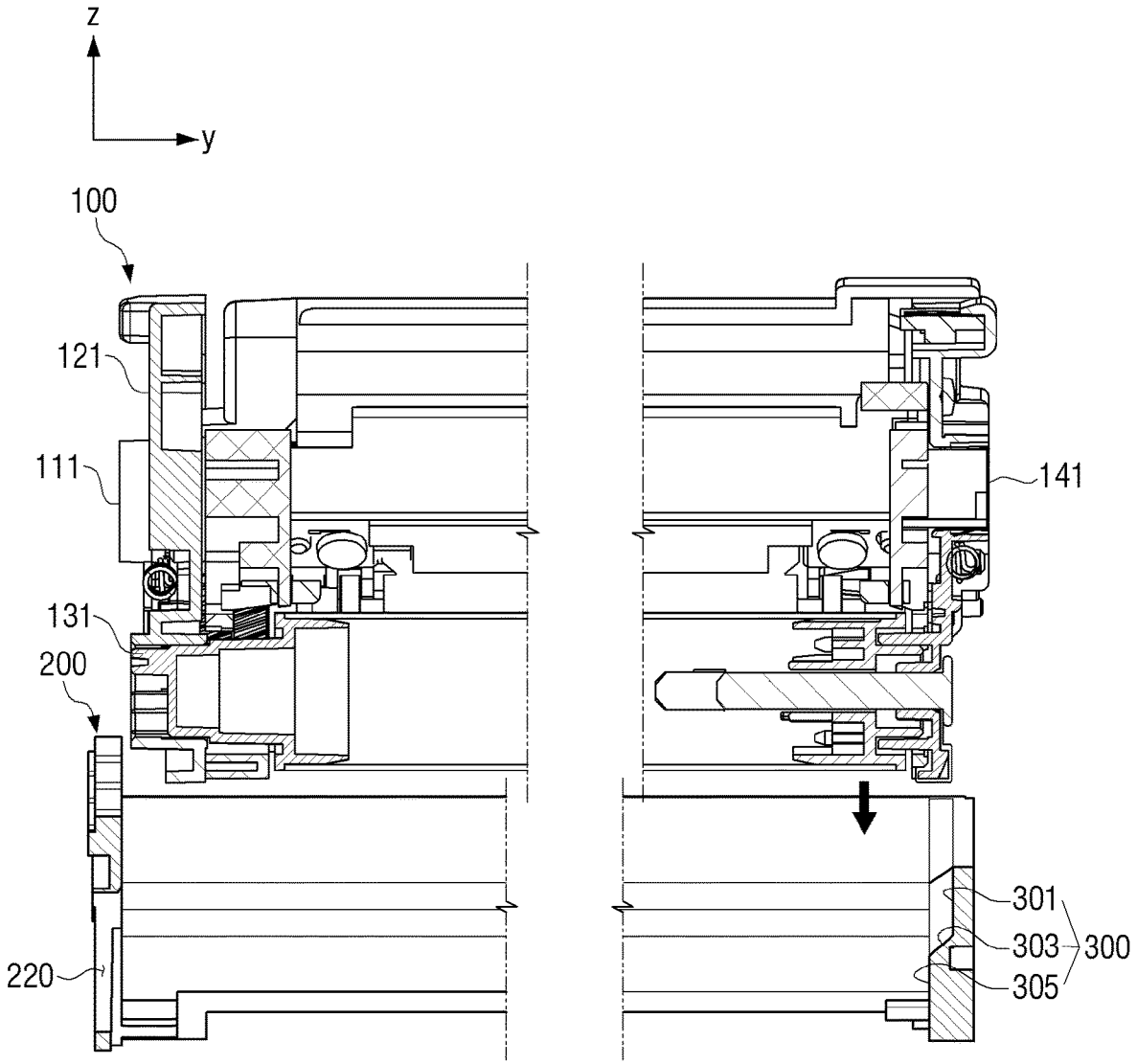

[Fig. 6b]
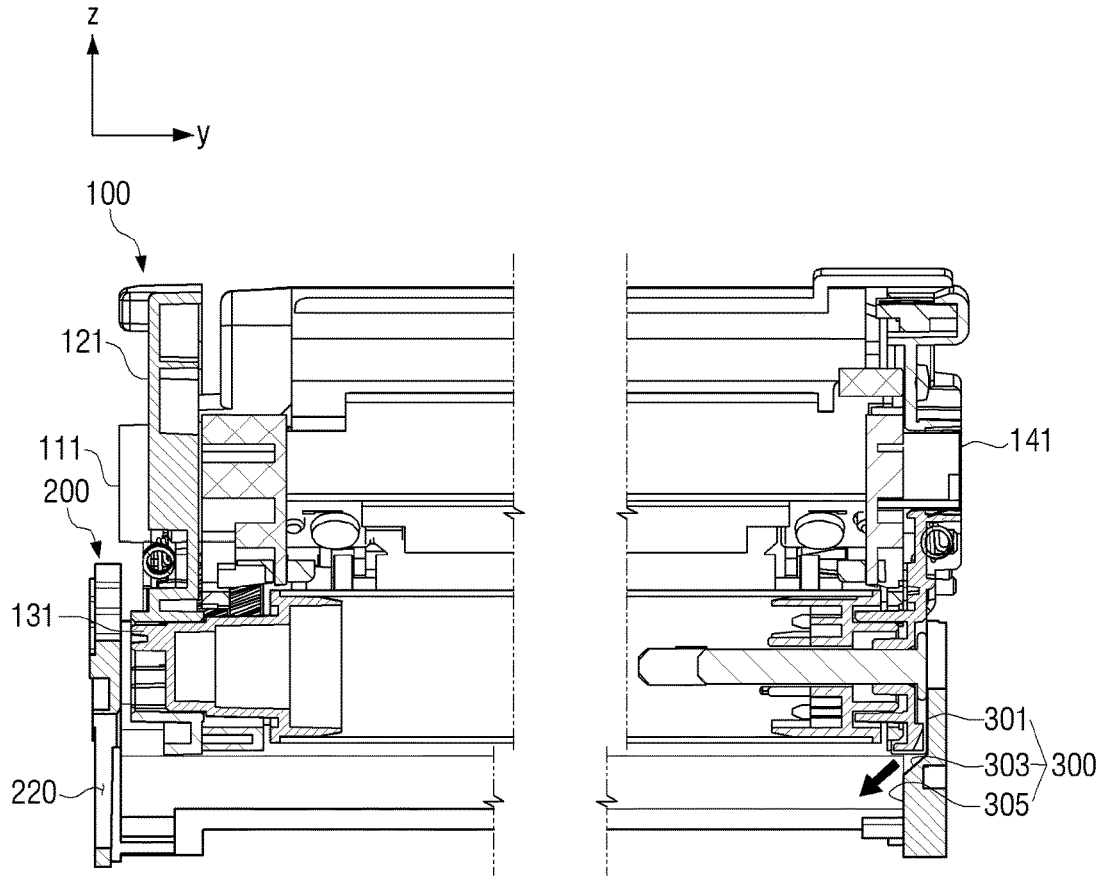
[Fig. 6c]
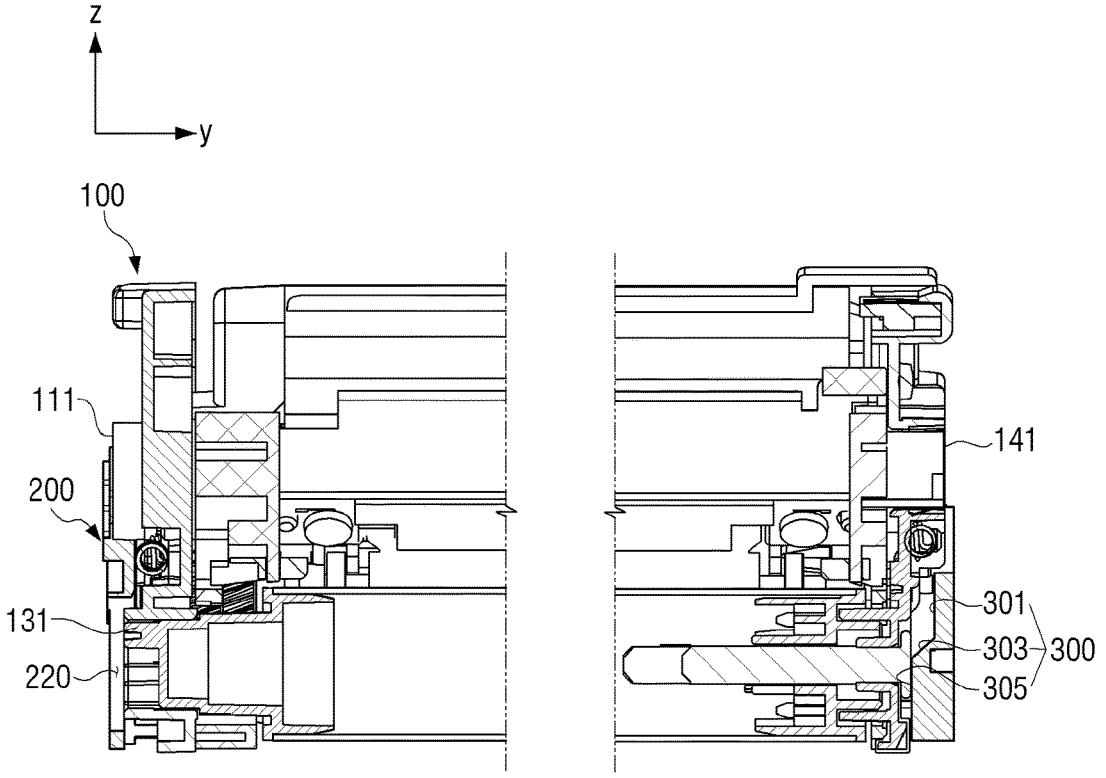

[Fig. 7]
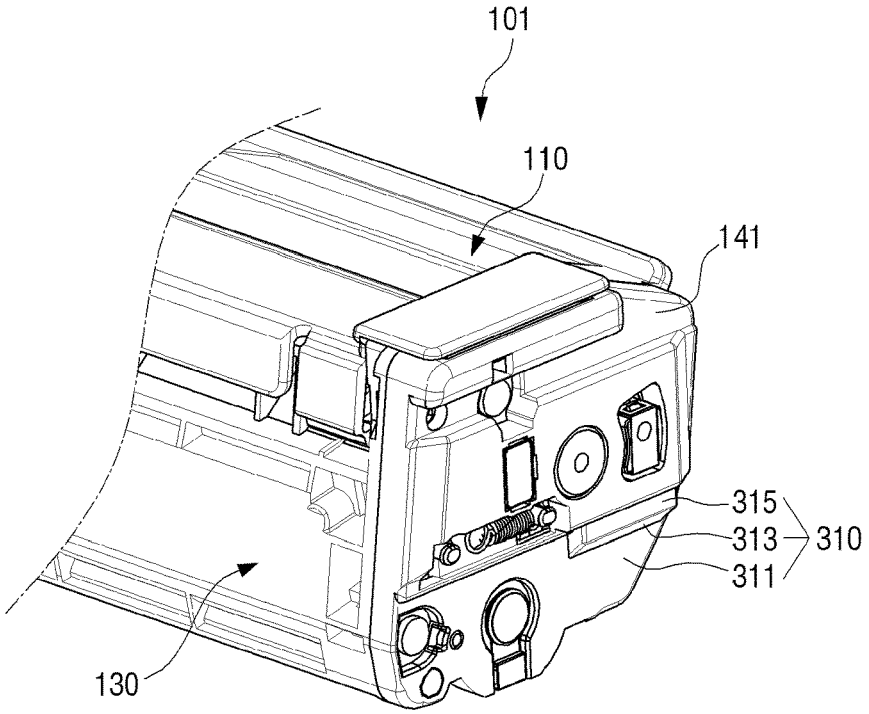
[Fig. 8a]
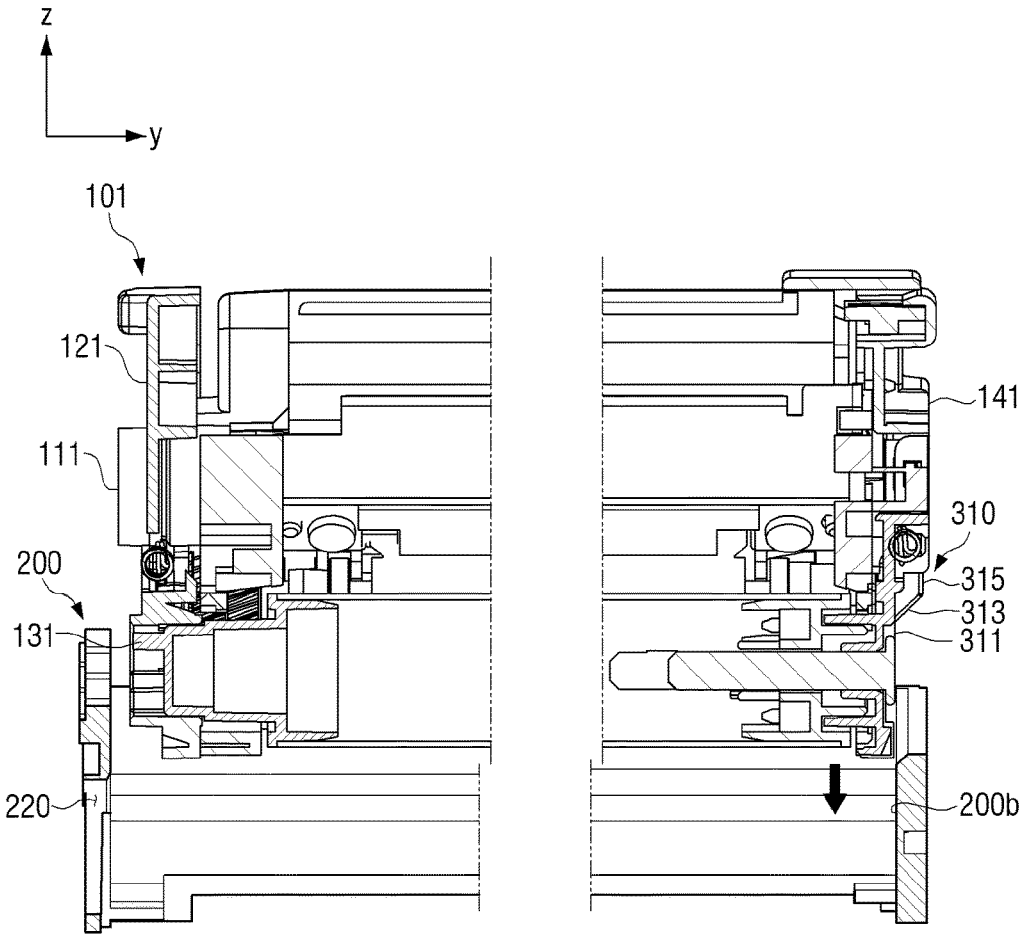

[Fig. 8b]
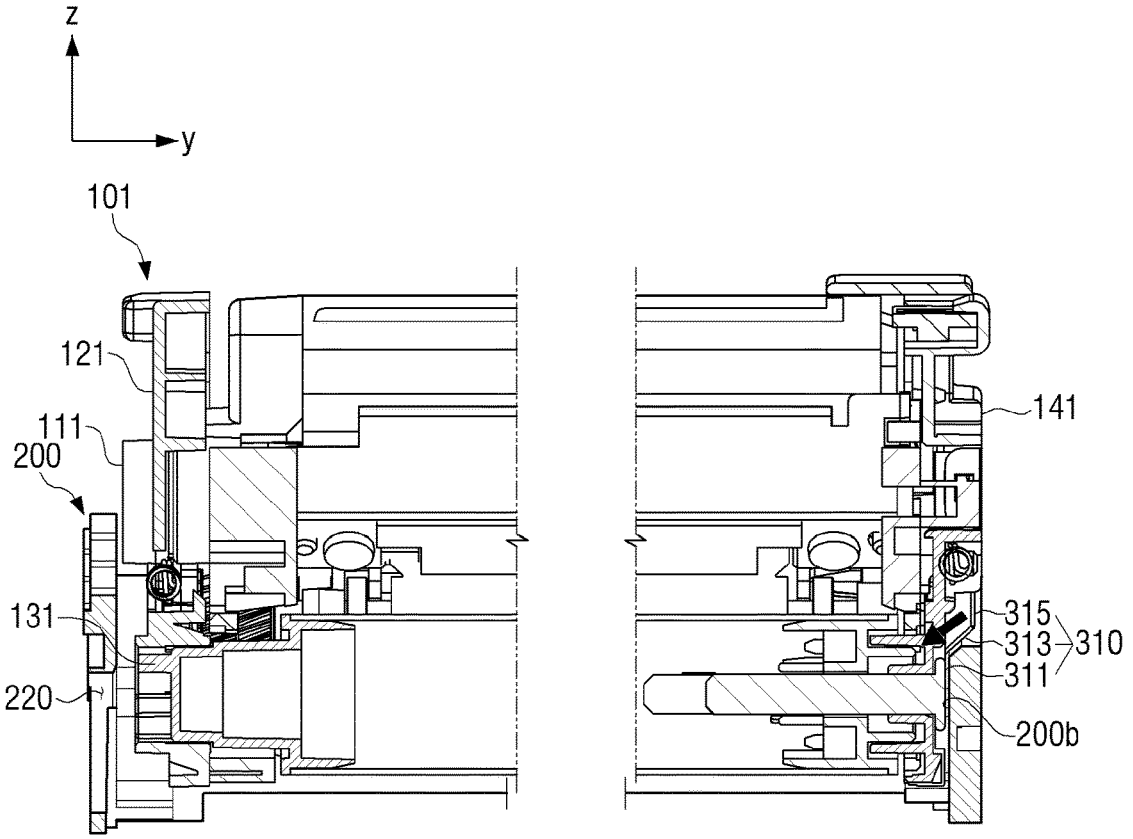
[Fig. 8c]
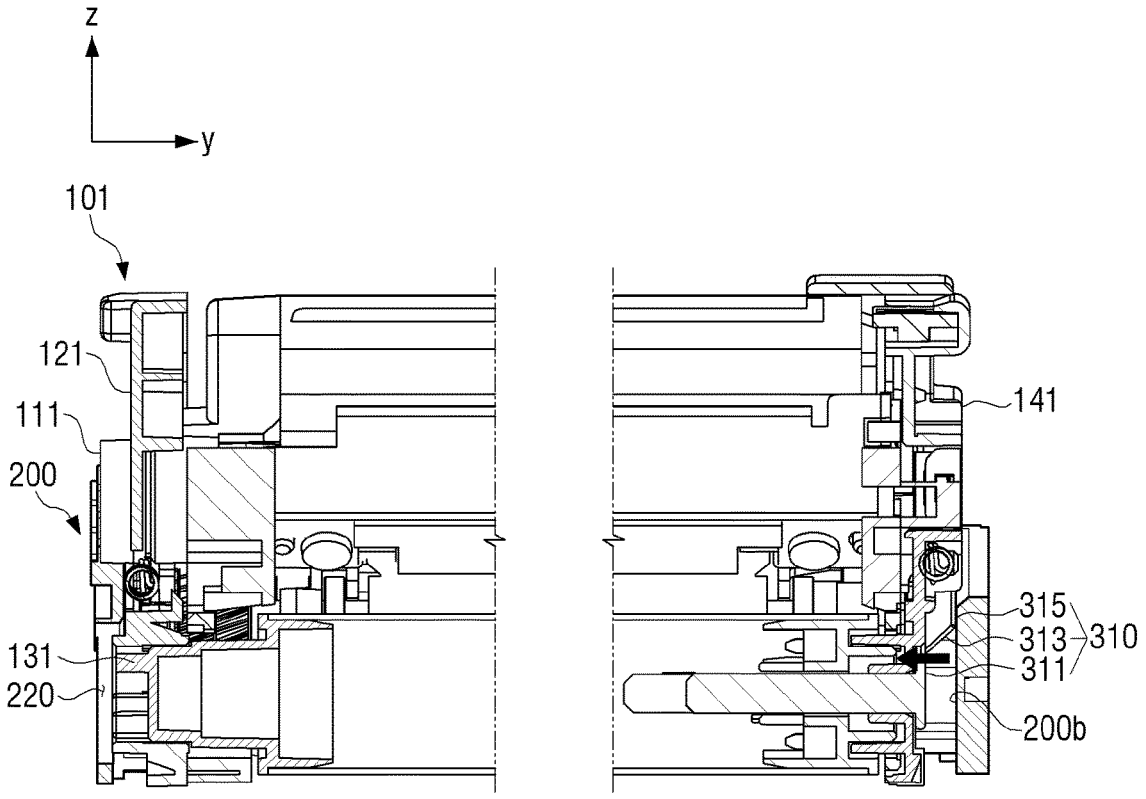

[Fig. 9a]
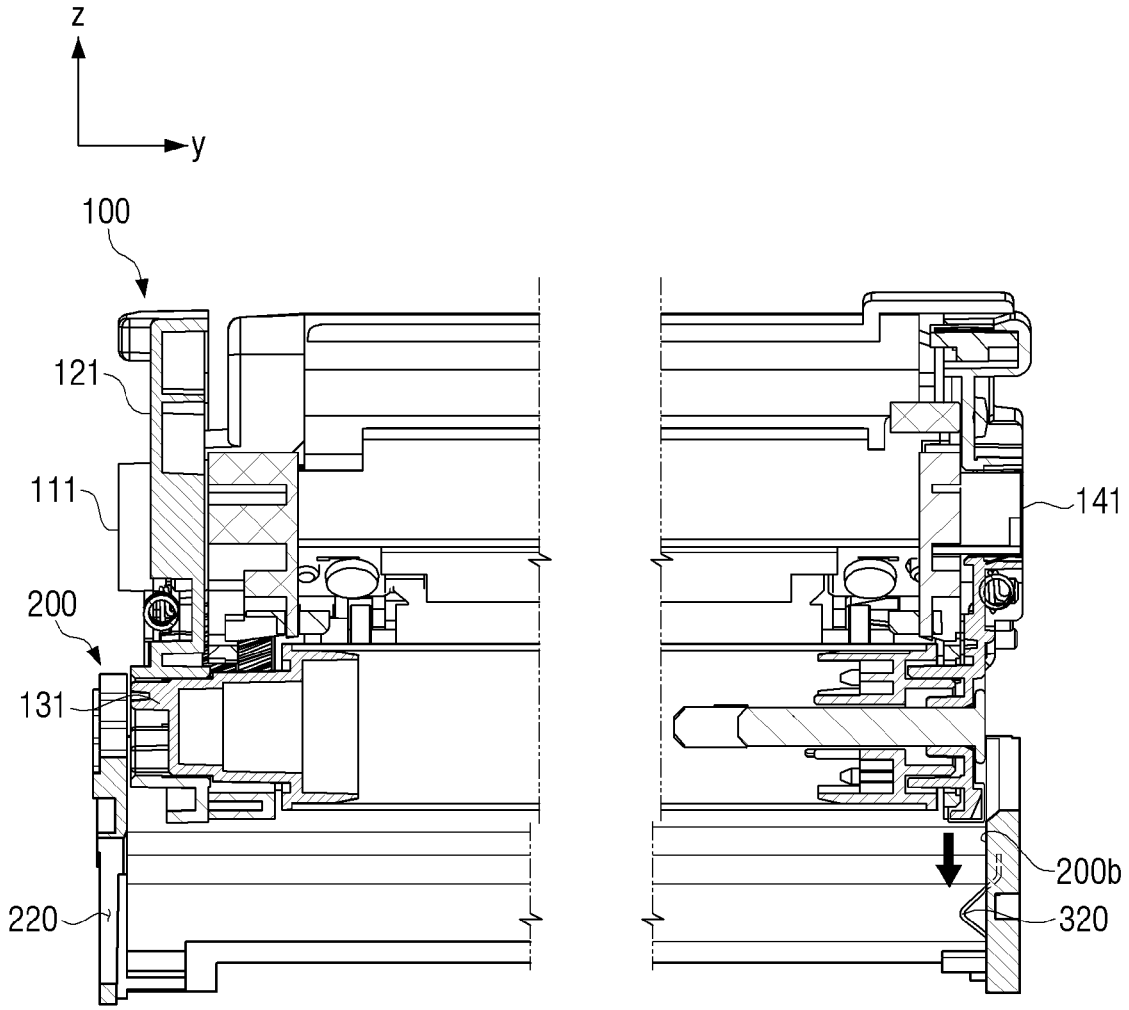

[Fig. 9b]
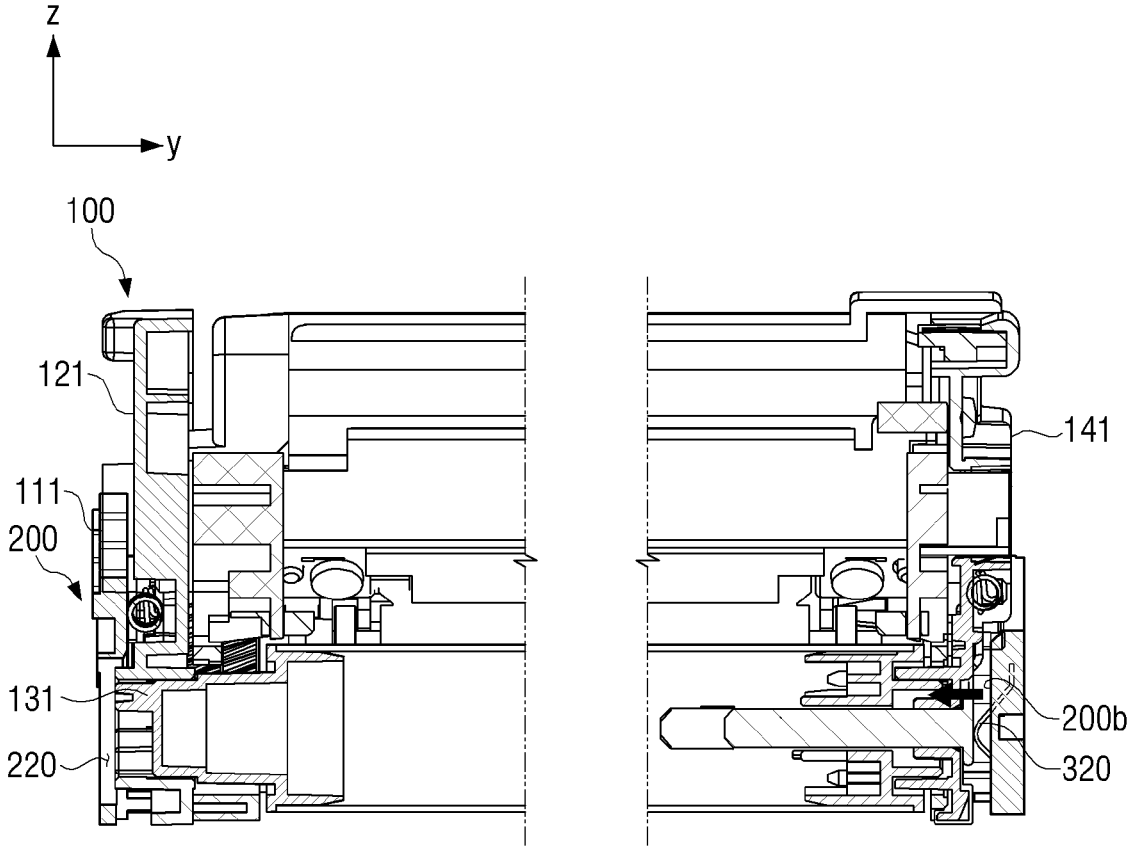

[Fig. 10]
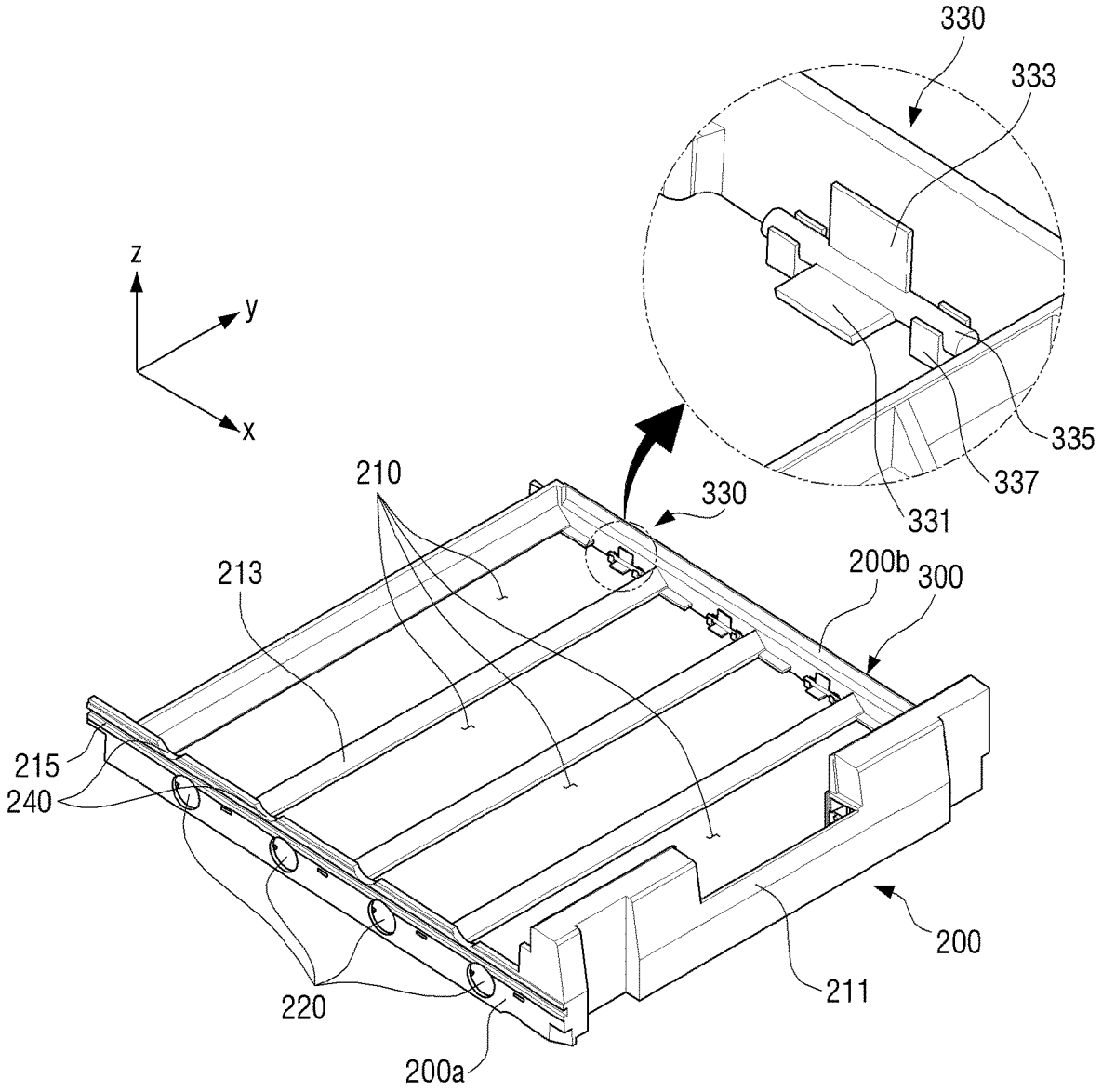

[Fig. 11a]
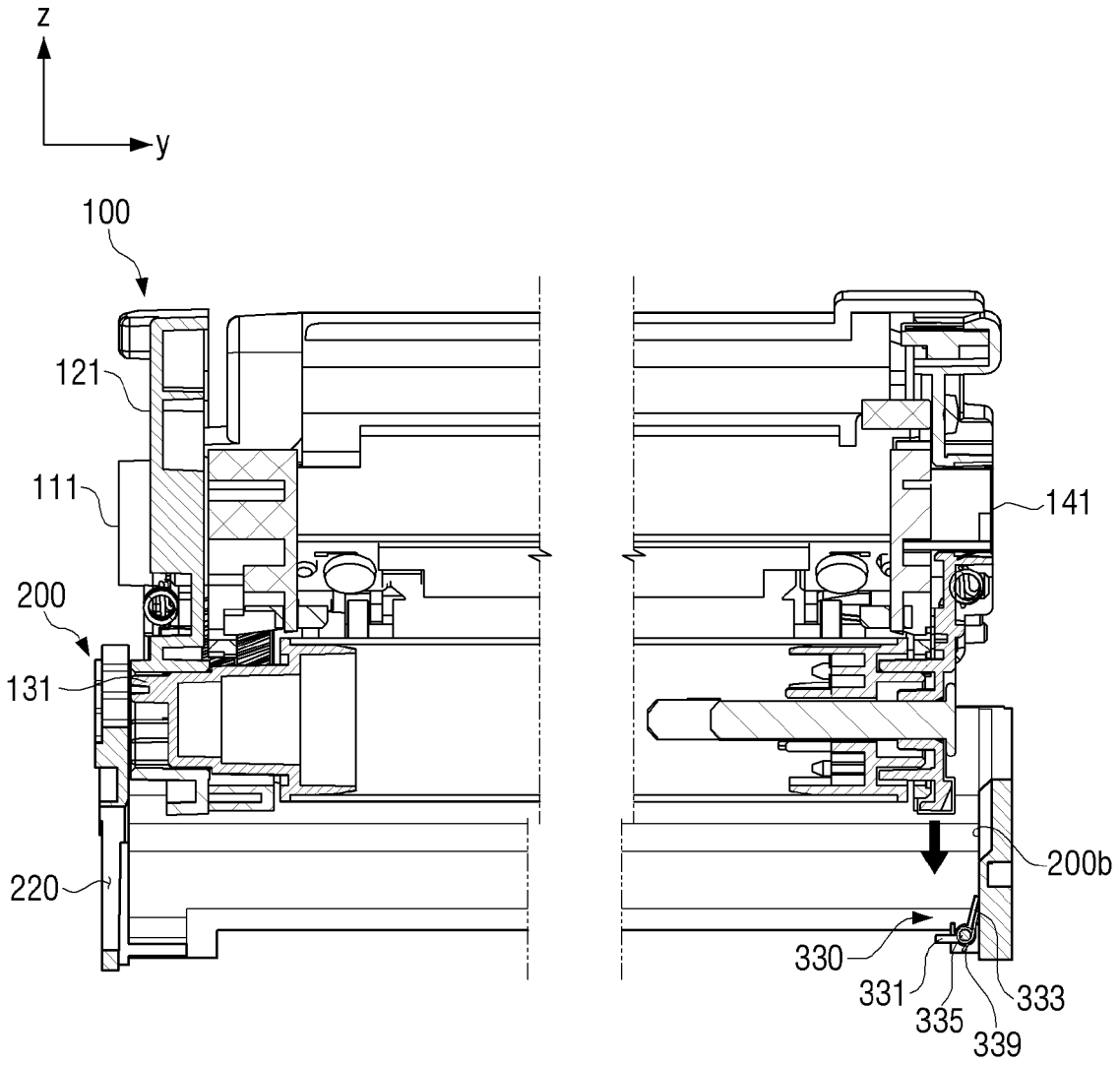

[Fig. 11b]
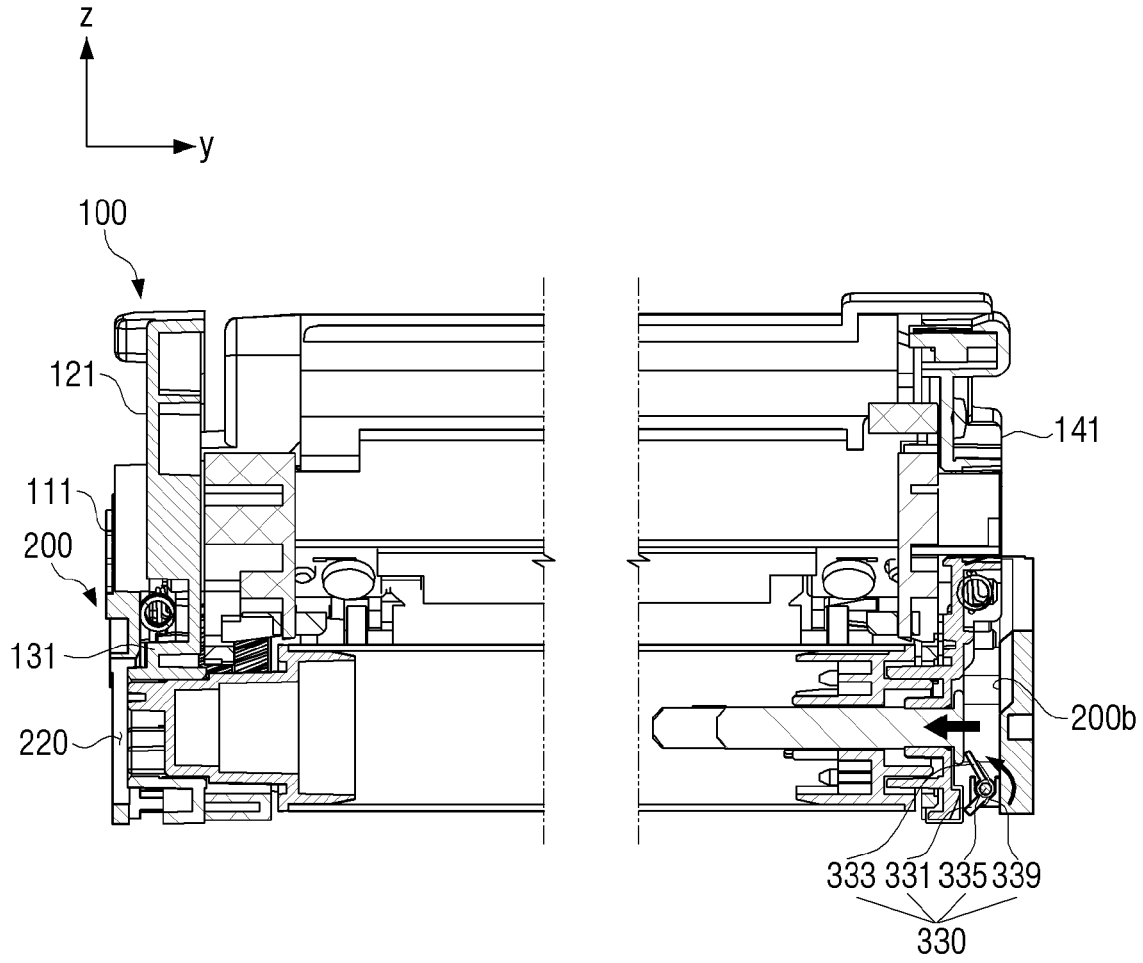

GUIDE MEMBER FOR MOUNTING A CONSUMABLE CARTRIDGE ON A TRAY

CROSS REFERENCE TO RELATED APPLICATIONS

This application is filed under 35 U.S.C. 0.371 as a National Stage of PCT International Application No. PCT/KR2018/005485, filed on May 14, 2018, in the Korean Intellectual Property Office, which claims the priority benefit of Korean Patent Application No. 10-2018-0007920, filed on Jan. 22, 2018, in the Korean Intellectual Property Office. The disclosure of PCT International Application No. PCT/KR2018/005485, filed on May 14, 2018, is incorporated by reference herein in its entirety. The disclosure of Korean Patent Application No. 10-2018-0007920, filed on Jan. 22, 2018, is incorporated by reference herein in its entirety.

BACKGROUND ART

An image forming apparatus refers to an apparatus that forms images on a recording medium according to inputted signals, and examples may include a printer, a copy machine, a facsimile, and a multi-function unit combining and implementing functions of the above.

One type of image forming apparatuses is an electrophotographic image forming apparatus, which is provided with a consumable cartridge including a photosensitive drum and a developing roller and a light exposure unit. The light exposure unit forms electrostatic latent images on a surface of the photosensitive drum by emitting light onto the photosensitive drum charged with certain electric potential, and the developing device forms visible images by supplying a developer to the photosensitive drum formed with the electrostatic latent images.

The consumable cartridge is an assembly of parts for forming visible toner images, and it is consumable because it can be mounted on a tray, and taken out of a main body of the image forming apparatus and replaced upon expiration of its service life.

In order to keep a certain image quality, the consumable cartridge may be arranged at a certain position inside the main body of the image forming apparatus, and accordingly, the main body is provided with a support formed therein to support the consumable cartridge so that the consumable cartridge can be arranged at a fixed position.

For example, recently-available image forming apparatuses are designed so that a user can mount and demount and repair the consumable cartridge more conveniently. Users of such image forming apparatuses may mount and demount the consumable cartridges with increased convenience because the user can push or take a consumable cartridge mounted on a tray into or out of the main body.

Because the related consumable cartridges are mounted on the tray in a fixed mounting direction, forms of the consumable cartridge and the tray may be confined and inner space of the main body of the image forming apparatus may be limited according to the form of the consumable cartridges mounted on the tray. Such a mounting structure of the consumable cartridges hinders compactness of the image forming apparatus.

BRIEF DESCRIPTION OF DRAWINGS

FIG. 1 is a perspective view illustrating a tray being taken out of an image forming apparatus according to an example;

FIG. 2 is a schematic cross-sectional view of an image forming apparatus according to an example;

FIG. 3 is a perspective view illustrating a consumable cartridge being mounted on the tray illustrated in FIG. 1;

FIG. 4 is a perspective view illustrating a consumable cartridge seen from a non-driving side according to an example;

FIG. 5 is a perspective view of a tray according to an example;

FIGS. 6A to 6C are cross-sectional views illustrating a process of mounting a tray including consumable cartridges according to an example;

FIG. 7 is a perspective view illustrating a consumable cartridge seen from a non-driving side according to an example;

FIGS. 8A to 8C are cross-sectional views illustrating a process of mounting a consumable cartridge on a tray according to an example;

FIGS. 9A and 9B are cross-sectional views illustrating a process of mounting a consumable cartridge on a tray according to an example;

FIG. 10 is a perspective view of a tray according to an example; and

FIGS. 11A and 11B are cross-sectional views illustrating a process of mounting a consumable cartridge on a tray according to an example.

MODE FOR THE INVENTION

Certain examples of the disclosure will now be described in greater detail with reference to the accompanying drawings. Examples to be explained in the following may be modified and implemented in various different forms.

Meanwhile, when it is stated herein that one element is "connected to" another element, the expression encompasses not only an example of "direct connection," but also "connection with another element interposed therebetween." Further, when it is stated herein that one element "includes" another element, unless otherwise stated specifically, it means that yet another element may be further included rather than being excluded.

Further, an "image forming apparatus" refers to an apparatus that prints printing data generated at a terminal such as a computer or the like on a recording paper. Examples of the image forming apparatus may include a copy machine, a printer, a facsimile, or a multi-function printer (MFP) that provides the multiple functions mentioned above on one single apparatus. The image forming apparatus may refer to any apparatus that can perform image forming jobs, such as a printer, a scanner, a facsimile, an MFP, a display apparatus, or the like.

Further, a "main scanning direction" refers to a scanning direction of a scanner, and for example, it is a direction perpendicular to a moving direction of printing paper.

Further, a "sub-scanning direction" refers to a moving direction of paper.

Further, elements having the same function within the scope of the technical art rep-resented on the drawings for each example will be explained by using the same drawing reference numerals.

FIG. 1 is a perspective view illustrating an image forming apparatus and a tray being taken out of the image forming apparatus according to an example, and FIG. 2 is a schematic cross-sectional view of an image forming apparatus according to an example.

An image forming apparatus, and for example, an electrophotographic image forming apparatus may form an electrostatic latent image on a surface of a photosensitive drum by emitting onto the photosensitive drum the light modulated according to image information, develop the electrostatic latent image into a visible toner image by supplying toner thereto, and print the image onto a recording medium by transferring and fixing the toner image on the recording medium.

The image forming apparatus according to an example is a single-pass type color image forming apparatus that uses yellow (Y), magenta (M), cyan (C), and black (K) colored toners, respectively. However, the disclosure may not be limited hereto, and a toner having various other colors such as light magenta, white, or the like may be further used.

Referring to FIGS. 1 and 2, the image forming apparatus 10 may include a main body 10*a*, a consumable cartridge 100, an intermediate transfer belt 20, a light exposure unit 40, an intermediate transfer roller 21, a final transfer roller 31, and a fuser 50.

While the main body 10*a* forms the overall external shape of the image forming apparatus 10, it may also support various parts mounted therewithin. Further, a cover 11 may be pivotably installed on one side of the main body 10*a*. The cover 11 may be to open and close an opening 13 of the main body 10*a*. Through the opening 13, the user may replace or repair various accessory parts or remove a paper jammed in an inner portion of the main body 10*a*. For example, the tray 200 may be taken out of the main body 10*a* and the consumable cartridge 100 mounted on the tray 200 may be removed from the tray 200 and replaced.

The tray 200 may be movably installed on an inner frame (not illustrated) provided on both inner sides of the main body 10*a* so as to be placed into and taken out of the main body 10*a*. Guide rails 215 may be movably installed on the inner frame, on both sides of the tray 200. Accordingly, when the tray 200 is taken out of the main body 10*a* through the guide rail 215, the consumable cartridge 100 (to be described below) mounted on the tray 200 may be separated therefrom and replaced.

The tray 200 may have a plurality of consumable cartridges (PY, PM, PC, PK) mounted thereon, and coupled with the main body 10*a* in a sliding manner. In this example, a hand grip 211 may be formed on an end of the tray 200 so that the user can take the tray 200 out of the main body 10*a* of the apparatus conveniently.

A plurality of consumable cartridges (PY, PM, PC, PK) may be coupled to and separated from the main body 10*a* of the apparatus as the tray 200 is placed into or taken out of the main body 10*a* of the apparatus, and accordingly, the user may conveniently replace a plurality of consumable cartridges (PY, PM, PC, PK) at once.

The consumable cartridge 100 is an assembly of the parts for forming visible toner image, and it is a consumable product that can be taken out of the main body 10*a* of the image forming apparatus while being mounted on the tray 200 and replaced upon expiration of service life.

The consumable cartridge 100 forms a toner image by attaching the toner received therein to the electrostatic latent image formed on the photosensitive drum 1 and may include a developing roller 2 for supplying the toner receiving in the consumable cartridge 100 to the electrostatic latent image formed on the photosensitive drum 1, and a charging roller 3 for charging a surface of the photosensitive drum 1 at a constant electric potential.

The consumable cartridge 100 may include four cartridges (PY, PM, PC, PK) respectively receiving therein the yellow (Y), magenta (M), cyan (C), and black (K) developers. The photosensitive drum 1 may be provided in each of the consumable cartridges (PY, PM, PC, PK). The consumable cartridges (PY, PM, PC, PK) will be referred to by a reference numeral "100" for convenience of explanation, instead of symbols "PY, PM, PC, PK*j Each consumable cartridge 100 may include a charging roller 3 for charging the photosensitive drum 1 and a developing roller 2 for forming visible image by supplying the developer onto the electrostatic latent image formed on each of the photosensitive drums 1.

The consumable cartridge 100 may have various structures, including a structure in which the photosensitive drum 1, the developing roller 2 for supplying toner to the photosensitive drum 1, and an reservoir receiving toner therein are integrated into one body, a structure in which an image cartridge provided with the photosensitive drum 1 and the developing roller 2 and a toner cartridge receiving toner therein are divided, or a structure in which a photosensitive drum cartridge provided with the photosensitive drum 1, a developing cartridge provided with the developing roller 2, and a toner cartridge receiving toner therein are divided, for example.

A developing bias voltage may be applied to the developing roller 2 for supplying toner to the electrostatic latent image, and a charging bias voltage may be applied to the charging roller 3. In this example, a corona charger may be used instead of the charging roller 3. The photosensitive drum 1 is one example of the photosensitive body formed with the photosensitive latent image. The photosensitive drum 1 may be formed with a photosensitive layer having photoconductivity on an outer circumference of a metal cylindrical pipe. The four photosensitive drums 1 may be in contact with an upper surface of the intermediate transfer belt 20.

The light exposure unit 40 may form an electrostatic latent image by emitting light corresponding to image information inputted from an external device such as a computer onto the photosensitive drum 1. For the color image forming apparatus 10 according to an example, the light exposure unit 40 may be to emit light corresponding to yellow (Y), magenta (M), cyan (C), and black (K) colors onto the photosensitive drum 1.

The transfer device transfers the developer image formed on the photosensitive drum 1 onto a recording medium P. The transfer device may include the transfer belt 20 circulating in contact with each photosensitive drum 1, a transfer belt driving roller 23 for driving the transfer belt 20, a transfer belt driven roller 24 for maintaining tension of the transfer belt 20, and four transfer rollers 21 for transferring the developer image of the photosensitive drum 1 onto the recording medium P.

The recording medium P is transferred while being attached to the transfer belt 20. At this time, voltage with opposite polarity to the polarity of the developer attached to each photosensitive drum 1 is applied onto each transfer roller 21, and accordingly, the developer image on each photosensitive drum 1 is transferred onto the recording medium P.

The fuser 50 is to provide heat and pressure to the recording medium P moving between the fuser 50 and fix the un-fixed images onto the recording medium P.

An ejector 60 ejects the recording medium P that has passed through the fuser 50 outside the image forming apparatus.

Further, when the developer included in consumable cartridge 100 described above is used up, the consumable cartridge 100 may be replaced. Accordingly, the tray 200 is provided on one side of the main body 10*a* and is movable into the main body 10*a*, and the consumable cartridges 100 are removably received in the tray 200 respectively.

FIG. 3 is a view illustrating a process of mounting a consumable cartridge on a tray in the example of the image forming apparatus illustrated in FIG. 1.

Referring to FIG. 3, in a replacement process of a plurality of the consumable cartridges 100, in order to replace a plurality of consumable cartridges 100, the cover 11 of the main body 10*a* may be opened, and the tray 200 may be taken out through the opening 13 formed on the main body 10*a*.

When the tray 200 is taken out of the main body 10*a*, an upper surface of a plurality of consumable cartridges 100 supported within the tray 200 may be exposed to outside. After the consumable cartridge (PK) 100 for replacement is separated from the tray 200, a new consumable cartridge (PK) 100 may be mounted. Further, the tray 200 coupled with the new consumable cartridge (PK) 100 may be inserted through the opening 13 of the main body 10*a* and mounted, and the cover 11 may be closed, and as a result, the consumable cartridge 100 for replacement is replaced with the new consumable cartridge (PK) 100.

The new consumable cartridge (PK) 100 is moved from a direction perpendicular to the tray 200 toward the tray 200, along a main scanning direction by a guide member 300 (to be described below) to be mounted on the tray 200.

FIG. 3 is a perspective view of a consumable cartridge seen from a driving side.

The direction left or right to each consumable cartridge 100 corresponds to a direction horizontal to an axis of the photosensitive drum 1. The consumable cartridge 100 may include the photosensitive drum 1, the developing roller 2, a first panel 121, and a second panel 141. The first panel 121 may be formed on one side that is a driving side with respect to a length direction of the consumable cartridge 100, and the second panel 141 may be formed on other side that is a non-driving side opposite to the first panel 121.

Each consumable cartridge 100 may be provided with a photosensitive drum driving coupling (first driving force input portion, i.e., drum driving force receiving portion) 131, and a developing roller driving coupling (second driving force input portion, i.e., developing driving force receiving portion) 111, on the first panel 121 in a length direction of a driving side of the consumable cartridge 100.

The photosensitive drum driving coupling 131 and the developing roller driving coupling 111 may be projected from the first panel 121.

When the consumable cartridges 100, which are mounted on the tray 200, are moved to a predetermined image forming position within the main body 10*a*, the photosensitive drum driving coupling 131 and the developing roller driving coupling 111 are coupled with the first and second driving force output portions (not illustrated) formed within the main body 10*a*, respectively.

The photosensitive drum 1 is rotationally driven at a predetermined circumferential speed by the driving force delivered from the first driving force output portion to the photosensitive drum driving coupling 131. The charging roller 3 is rotated according to the rotation of the photosensitive drum 1.

The developing roller 2 is rotated with a predetermined circumferential speed by the driving force delivered from the second driving force output portion to the developing roller driving coupling 111.

The consumable cartridge 100 according to an example may minimize space for connection between the driving unit and the consumable cartridge 100, because, for mounting on the tray 200, the consumable cartridge 100 is moved in the main scanning direction which is the direction of the first driving force output portion and the second driving force output portion installed within the main body 10*a*. For example, when the consumable cartridge 100 is mounted on the tray 200, the photosensitive drum driving coupling 131 and the developing roller driving coupling 111 are inserted into a passing hole 220 and a passing groove 240 of the tray 200, each of which will be described below.

The photosensitive drum coupling 131 is inserted into the passing hole 220 of the tray 200 and moved by a predetermined distance toward the Y axis direction and supported thereat. The photosensitive drum coupling 131 receives the driving force of the driving unit and provides the received driving force to the photosensitive drum 1 by being contacted with the photosensitive drum 1.

The first driving force output portion formed on the main body 10*a* is in Y axis direction and coupled with the photosensitive drum driving coupling 131. Accordingly, the photosensitive drum 1 can be rotated with the driving force from the driving unit.

Because the photosensitive drum driving coupling 131 is mounted after being moved in the −Y axis direction, the moving distance for coupling of the first driving force output portion may be reduced. The driving force output portion may reduce driving space for movement, because it is moved closer to the photosensitive drum driving coupling 131 as much as the moving distance of the photosensitive drum driving coupling 131 in the main scanning direction. The driving space of the main body may be designed smaller as an amount of movement of the driving force output portion is reduced.

Likewise, the developing roller driving coupling 111 is inserted into the passing groove 240 of the tray 200 and moved by a predetermined distance toward Y axis direction and supported thereat. The developing roller coupling 111 may receive the driving force delivered from the second driving force output portion and provide the delivered driving force to the developing roller 2 by being connected to the developing roller 2.

The second driving force output portion formed on the main body 10*a* is moved in the Y axis direction and coupled with the developing roller driving coupling 111. Accordingly, the developing roller 2 is rotated with the driving force from the driving unit.

Because the developing roller driving coupling 111 is mounted after being moved in the −Y axis direction, the moving distance for coupling of the second driving force output portion may be reduced. The second driving force output portion may reduce driving space for movement because it is moved closer to the developing roller driving coupling 111 as much as the moving distance of the developing roller driving coupling 111 in the main scanning direction. The driving space of the main body may be designed smaller as the amount of movement of the second driving force output portion is reduced.

Because the photosensitive drum driving coupling 131 and the developing roller driving coupling 111 are moved in the main scanning direction and arranged, an amount of retreat of the driving force output portion is reduced, and the driving space inside the main body 10*a* can be designed small. The overall size of the image forming apparatus can thus be reduced as the driving space is reduced.

Further, the consumable cartridge 100 and the tray 200 overlap with each other as much as the photosensitive drum driving coupling 131 and the developing roller driving coupling 111 are seated in the passing hole 220 and the passing groove 240. Accordingly, width of the tray 200 may be equal to or less than the width of the consumable cartridge 100. Because the tray 200 can be designed smaller as much as the space in which the consumable cartridge 100 and the tray 200 overlap, the image forming apparatus 100 can be miniaturized.

Further, the tray 200 mounted with the consumable cartridge 100 may enhance rigidity of the tray 200, since the tray 200 overlaps with a portion of the consumable cartridge 100.

FIG. 4 is a perspective view of a cartridge seen from a non-driving side of the consumable cartridge 100 according to an example, and FIG. 5 is a perspective view of a tray 200 according to an example.

Referring to FIG. 4, the second panel 141, guided by the guide member 300 of the tray 200 to be described below, may move the consumable cartridge 100 in the main scanning direction.

Referring to FIG. 5, the tray 200 includes a rectangular main frame including four cartridge compartments where the four consumable cartridges (PY, PM, PC, PK) may be mounted. The space within the rectangular main frame may be partitioned into four rectangular cartridge compartments having almost the same size, by three supports 213. A plurality of consumable cartridges (PY, PM, PC, PK) may be respectively inserted into the four cartridge compartments and supported therewithin. The supports 213 of the tray 200 may support the consumable cartridges (PY, PM, PC, PK).

On one side surface 200*a* in a length direction of each cartridge compartment corresponding to one side surface 200*a* (driving side) of the main frame of the tray 200, a passing hole 220 and a passing groove 240 may be formed. Through the passing hole 220 and the passing groove 240, the first and second driving force output portions within the main body 10*a* may be connected to the photosensitive drum driving coupling 131 and the developing roller driving coupling 111 of the consumable cartridge 100.

The photosensitive drum driving coupling 131 may be seated in the passing hole 220, and the developing roller driving coupling 111 may be seated in the passing groove 240. In order to be mounted on the tray 200, the consumable cartridge 100 may be moved and mounted in the main scanning direction perpendicular to a mounting direction so that the photosensitive drum driving coupling 131 and the developing roller driving coupling 111 of the consumable cartridge 100 are respectively inserted into the passing hole 220 and the passing groove 240 of the tray 200 and seated therein, respectively. During mounting, the consumable cartridge 100 may be moved in the main scanning direction by the guide member 300 to be described below.

The tray 200 according to an example includes the guide member 300 for guiding the consumable cartridge 100 in the main scanning direction.

The guide member 300 for guiding the consumable cartridge 100 in a scanning main direction may be provided on other side surface 200*b* in a length direction of each cartridge compartment corresponding to other side surface 200*b* (non-driving side) of the main frame of the tray 200.

The guide member 300 may include a first surface 301 that forms the other side surface 200*b* of the tray 200, a second surface 305 spaced inwardly from the first surface 301, and an inclined surface 303 connecting the first surface 301 and the second surface 305. The consumable cartridge 100 may be moved in a mounting direction along the first surface 301, then moved in the main scanning direction along the inclined surface 303, and then moved in a mounting direction along the second surface 305, and then mounted.

The inclined surface 303 may be downwardly inclined toward the inner portion of the tray 200. Because the consumable cartridge 100 is moved in the main scanning direction along the inclined surface 303, the inclined surface 303 may be downwardly inclined in the main scanning direction. Further, the inclined surface 303 may be downwardly inclined to the direction of the passing hole 220 formed on one side surface 200*a* that is opposite the other side surface 200*b* where the guide member 300 is formed.

The guide member 300 may be injection-molded so that, in the manufactured tray 200, the guide member 300 includes the downwardly inclined surface 303, while having the other side surface 200*b* on an inner side. In other words, the guide member 300 may be integrated with the tray 200 on the other side surface 200*b* of the tray 200. However, the disclosure may not be limited hereto, and accordingly, the guide member 300 may be provided as a separate structure, in which case it 300 may be installed on the other side surface 200*b* of the tray 200.

It is possible to guide the consumable cartridge 100 using the guide member 300 such that the consumable cartridge 100 is mounted on the tray 200 in the main scanning direction. Position of the consumable cartridge 100 may be controlled by setting a mounting direction of the consumable cartridge 100 through the guide member 300.

As described above, the guide member 300 has a simple structure. According to the examples of the disclosure, it is possible to minimize increasing number of parts for movement of the consumable cartridge 100 in the main scanning direction, and also possible to enhance the mounting power of the consumable cartridge.

FIGS. 6A to 6C are cross-sectional views illustrating a process of mounting a tray of a consumable cartridge according to an example.

Referring to FIG. 6A, the consumable cartridge 100 is prior to being mounted on the tray 200. The consumable cartridge 100 may be moved in a mounting direction perpendicular to the tray 200. Referring to FIG. 6B, the consumable cartridge 100 may be moved in the main scanning direction along the guide member 300 formed on the other side surface 200*b* of the tray 200. For example, the consumable cartridge 100 may be moved in the main scanning direction simultaneously upon moving in a mounting direction along the inclined surface 303.

Referring to FIG. 6C, after being moved in a mounting direction along the second surface 305 and then moved in the main scanning direction, the consumable cartridge 100 in such a state may be mounted on the tray 200. Accordingly, the photosensitive drum driving coupling 131 projected from the first panel 121 of the consumable cartridge 100 may be engaged with the passing hole 220.

While the consumable cartridge 100 is being mounted on the tray 200, by the guide member 300, the consumable cartridge 100 may be brought into contact with the tray 200 and moved in a mounting direction and simultaneously guided in the main scanning direction. Accordingly, the consumable cartridge 100 may be pressed toward a main scanning direction such that the photosensitive drum driving coupling 131 may be engaged with the passing hole 220.

FIG. 7 is a perspective view of a consumable cartridge according to an example.

Referring to FIG. 7, the consumable cartridge 101 includes the guide member 310 for guiding the consumable cartridge 101 in the main scanning direction with respect to the tray 200. The guide member 310 may be formed on the second panel 141.

The guide member 310 may include a first surface 311 that forms an outer side surface of the second panel 141, a second surface 315 formed outer than the first surface 311, and an inclined surface 313 connecting the first surface 311 and the second surface 315.

The inclined surface 313 may be inclined downwardly in the main scanning direction. Because the consumable cartridge 101 moves in the main scanning direction along the other side surface 200*b* of the tray 200 by the inclined surface 313, the inclined surface 313 may be downwardly inclined in the main scanning direction. Further, the inclined surface 313 may be downwardly inclined to the direction of the photosensitive drum coupling 131 formed on one side surface 200*a* opposite the other side surface 200*b* where the guide member 310 is formed.

FIGS. 8A to 8C are cross-sectional views illustrating a process of mounting a tray of a consumable cartridge according to an example.

Referring to FIG. 8A, the consumable cartridge 101 is in a state prior to being mounted on the tray 200. The consumable cartridge 101 is moved so that the first surface 311 of the guide member 310 is moved in a mounting direction (arrowed direction) along the tray 200. Referring to FIG. 8B, the consumable cartridge 101 may be moved in the main scanning direction along the tray 200 by the inclined surface 313 of the guide member 310. For example, the consumable cartridge 101 may be moved in a mounting direction by the inclined surface 313, while being simultaneously moved in the main scanning direction. Referring to FIG. 8C, the consumable cartridge 101, which has been moved in the main scanning direction by the second surface 315, is mounted on the tray 200. Accordingly, the photosensitive drum driving coupling 131 projected from the first panel 121 of the consumable cartridge 101 may be engaged with the passing hole 220.

During a process of mounting the consumable cartridge 101 on the tray 200, the consumable cartridge 101 is moved in a mounting direction in contact with the tray 200 by the guide member 310, while also being simultaneously guided in the main scanning direction. Accordingly, the consumable cartridge 101 is pressed in the main scanning direction, causing the photosensitive drum driving coupling 131 to be engaged with the passing hole 220.

FIGS. 9A and 9B are cross-sectional views illustrating a process of mounting a tray of a consumable cartridge according to an example.

Referring to FIGS. 9A and 9B, the guide member installed on the tray 200 may include an elastic member 320 to elastically support the consumable cartridge 100 in the main scanning direction.

The elastic member 320 may be arranged on the tray 200 and arranged on the other side surface 200*b* opposite to the one side surface 200*a* where the passing hole 220 is formed.

The elastic member 320 may elastically urge the consumable cartridge 100 mounted on the tray. A constitution of the elastic member 320 may not be limited and may be formed as a coil spring, plate spring, fluid spring, elastic material or the like.

While being mounted on the tray 200, the consumable cartridge 100 is moved within the tray 200 in the main scanning direction under the force exerted from the elastic member 320. Accordingly, it is accelerated by the elastic force until when the photosensitive drum driving coupling 131 of the consumable cartridge 100 is inserted in the passing hole 220 of the tray 200. While the consumable cartridge 100 is moved in the main scanning direction, the elastic force of the elastic member 320 may be converted into momentum of the consumable cartridge 100.

The elastic member 320 is capable of not only guiding the consumable cartridge 100 in the main scanning direction, but also electrically connecting the ground of the consumable cartridge to the ground of the main body. The elastic member 320 serving as an input contact member may be electrically connected to an output contact member (not illustrated) installed on the main body 10*a*. As a result, bias voltage from the electrical source installed within the main body 10*a* may be delivered from the output contact member to the elastic member 320 as the input contact member. The elastic member 320 may be formed from a conductive metal member. For example, the elastic member 320 may be formed from copper, aluminum, tin, platinum, or the like.

The consumable cartridge 100 mounted on the tray 200 may be moved in the main scanning direction with force exerted from the elastic member 320 and electrically connect to the electrical source of the main body 10*a*.

The consumable cartridge 100 may be mounted in a mounting direction and moved in the main scanning direction under the force exerted from the elastic member 320 arranged on the tray 200 to be mounted on the tray 200. Accordingly, the photosensitive drum driving coupling 131 projected from the first panel 121 of the consumable cartridge 100 may be engaged with the passing hole 220.

FIG. 10 is a perspective view of a tray according to an example.

FIGS. 11A and 11B are cross-sectional views illustrating a process of mounting a tray of a consumable cartridge according to an example.

Referring to FIG. 10, the guide member installed on the tray 200 may be formed as a hinge member 330 that rotates upon mounting of the consumable cartridge 100 to urge the consumable cartridge 100 in the main scanning direction.

The hinge member 330 may include a first rotation part 331 rotated with weight of the consumable cartridge when the consumable cartridge is mounted, a second rotation part 333 that applies force on the consumable cartridge 100 so that the consumable cartridge 100 is moved in the main scanning direction within the tray 200, and a rotation spring 339 that elastically supports the first and second rotation parts 331, 333 so that the first and second rotation parts 331, 333 are rotated.

The hinge member 330 may be rotatably installed on the tray 200 so that the hinge member 330 is rotated in a first direction which is a mounting direction when the consumable cartridge 100 is mounted, and rotated in a second direction opposite to the first direction when the consumable cartridge 100 is demounted.

In order to move the consumable cartridge 100 in the main scanning direction, a hinge member 330 may be formed on the tray 200 to move the consumable cartridge 100 by applying force in the main scanning direction.

The hinge member 330 may include the first rotation part 331 rotated with weight of the consumable cartridge 100, the second rotation part 333 rotating with the first rotation part 331 and moving the consumable cartridge 100 by applying force thereto, and the rotation spring 339 for elastically supporting the first and second rotation part 331, 333 so that the first and second rotation part 331, 333 are rotated.

The first rotation part 331 is rotatably installed on the tray 200 to be rotated in a first direction upon mounting of the consumable cartridge 100, and may rotate the second rotation part 333 that is cooperated with the first rotation part 331 in the first direction.

The second rotation part 333 may have the same rotation axis 335 as the first rotation part 331, in which case the second rotation part 333 is rotated together, by the rotation of the first rotation part 331. The second rotation part 333 may be spaced apart by a predetermined angle from the first rotation part 331. The first rotation part 331 and the second rotation part 333 may be spaced apart from each other by a distance that can allow the consumable cartridge 100 to be positioned therebetween.

The second rotation part 333 is rotated together with the first rotation part 331 in the first direction to urge a side surface of the consumable cartridge 100. The consumable cartridge 100 is moved in the main scanning direction by the force delivered form then second rotation part 333.

The rotation spring 339 may include a coil spring installed on the rotation axis 335. In this example, the rotation spring 339 may elastically support the first rotation part 331 and the second rotation part 333 so that the hinge member 330 is rotated in the second direction.

The hinge member 330 is rotated in accordance with mounting and demounting of the consumable cartridge 100. In other words, the hinge member 330 is rotated in the first direction during a process of mounting the consumable cartridge 100 on the tray 200, and rotated in the second direction during a process of demounting the consumable cartridge 100 from the tray 200.

The second rotation part 333 may be integrally extended by a distance from one rotation axis 335 to be operated in cooperation with the first rotation part 331.

The first rotation part 331 may be extended toward the direction of the passing hole 220 and arranged at a height such that the consumable cartridge 100 is rotated in the mounting direction while being mounted on the tray 200. Accordingly, during a process in which the consumable cartridge 100 is moved in a mounting direction and mounted on the tray 200, the consumable cartridge 100 is locked with the first rotation part 331, thus causing the first rotation part 331 to be rotated in the mounting direction. In accordance with the first rotation part 331 rotating in the first direction, the second rotation part 333 is rotated in the first direction together. The second rotation part 333 may apply force to the consumable cartridge 100 mounted between the first rotation part 331 and the second rotation part 333, and accordingly, the consumable cartridge 100 is moved in the main scanning direction.

The following will explain operation of an image forming apparatus 100 as described above according to an example by referring to drawings.

First, when the consumable cartridge 100 is moved and installed on the tray 200, as illustrated in FIG. 11A, the consumable cartridge 100 is moved in a mounting direction (arrowed direction) within the tray 200 and the hinge member 330 formed on the other side surface 200*b* of the tray 200 is brought into contact with the consumable cartridge 100. As illustrated in FIG. 11B, the first rotation part 331 is rotated in the first direction by the weight of the consumable cartridge 100 moving in the mounting direction. According to the rotation of the first rotation part 331, the second rotation part 333 is also rotated in the first direction.

The second rotation part 333 rotating in the first direction urges a side surface of the consumable cartridge 100, and the consumable cartridge 100 is moved in the main scanning direction by the force exerted from the second rotation part 333.

The photosensitive drum driving coupling 131 formed on the first panel 121 of the consumable cartridge 100 is inserted into the passing hole 220 of the tray 200 as the consumable cartridge 100 is moved in the main scanning direction. The consumable cartridge 100 may be moving in the main scanning direction by the force of the second rotation part 333 supporting the consumable cartridge 100 and fixed in the mounted state.

Because the hinge member 330 supports the second panel 141 of the consumable cartridge 100 after the consumable cartridge 100 is completely mounted within the tray 200, the hinge member 330 may be kept in the state of being rotated in the first direction.

Next, when the consumable cartridge 100 is separated from the tray 200, the hinge member 330 supporting the consumable cartridge 100 is rotated in the second direction with the elastic restoring force of the rotation spring 339.

The removal of the consumable cartridge 100 that has supported the first rotation part 331 causes the first rotation part 331 to be rotated in the second direction with elastic restoring force of the rotation spring 339, and the second rotation part 333 is also simultaneously rotated in the second direction.

As described above, the disclosure may be also applied to S path-type of the image forming apparatus as well as C path-type of the image forming apparatus.

The foregoing examples are merely examples and are not to be construed as limiting the disclosure. The disclosure can be readily applied to other types of apparatuses. Also, the description of the examples of the disclosure is intended to be illustrative, and not to limit the scope of the claims.

The invention claimed is:

1. An image forming apparatus, comprising:

a main body; and a tray, on which a plurality of consumable cartridges are mountable, movable between an inner portion of the main body and outside of the main body, the tray including:

a plurality of passing holes formed on a first side surface of the tray, and a guide member, that during mounting of a consumable cartridge among the plurality of consumable cartridges on the tray, is to move the consumable cartridge in a direction perpendicular to a mounting direction of the consumable cartridge so that the consumable cartridge is mounted on the tray and so that a portion of the consumable cartridge is inserted into a passing hole among the plurality of passing holes.

2. The image forming apparatus of claim 1, wherein the portion of the consumable cartridge is a coupling projected from a first side surface of the consumable cartridge.

3. The image forming apparatus of claim 2, wherein the coupling is inserted into the passing hole when the consumable cartridge is mounted on the tray, and is to receive a driving force from a driving source disposed in the main body when the tray is disposed in the inner portion of the main body.

4. The image forming apparatus of claim 2, wherein the guide member includes an inclined surface formed on a second side surface of the tray opposite to the first side surface of the tray.

5. The image forming apparatus of claim 4, wherein the inclined surface is downwardly inclined in a direction toward the plurality of passing holes formed on the first side surface of the tray.

6. The image forming apparatus of claim 2, wherein the guide member includes an elastic member to elastically support the consumable cartridge in the direction perpendicular to the mounting direction of the consumable cartridge, during mounting of the consumable cartridge on the tray.

7. The image forming apparatus of claim 6, wherein the elastic member is disposed on a second side surface of the tray opposite to the first side surface of the tray.

8. The image forming apparatus of claim 6, wherein the elastic member is to electrically connect a ground of the consumable cartridge to a ground of the main body when the consumable cartridge is mounted on the tray.

9. The image forming apparatus of claim 2, wherein the guide member includes a hinge member to rotate during mounting of the consumable cartridge on the tray such that rotation of the hinge member urges the consumable cartridge in the direction perpendicular to the mounting direction of the consumable cartridge.

10. The image forming apparatus of claim 9, wherein the hinge member is formed on a second side surface of the tray opposite to the first side surface of the tray.

11. The image forming apparatus of claim 9, wherein the hinge member includes:

a first rotation part to rotate when in contact with a lower end of the consumable cartridge during mounting of the consumable cartridge on the tray, and a second rotation part, having a same rotation axis as the first rotation part, to rotate together with the first rotation part.

12. The image forming apparatus of claim 11, wherein the second rotation part applies a force to a side of the consumable cartridge to move the consumable cartridge in the direction perpendicular to the mounting direction of the consumable cartridge, when the second rotation part rotates together with the first rotation part.

13. The image forming apparatus of claim 11, wherein the first rotation part and the second rotation part are spaced apart from each other by a predetermined angle.

14. The image forming apparatus of claim 1, further comprising a scanner, wherein the direction perpendicular to the mounting direction of the consumable cartridge is a same direction as a scanning direction of the scanner.

15. The image forming apparatus of claim 1, wherein the guide member is disposed on a second side surface of the tray, opposite to the first side surface of the tray.

16. The image forming apparatus of claim 1, wherein when the portion of the consumable cartridge is inserted into the passing hole, the consumable cartridge is seated such that a width of the tray in the direction perpendicular to the mounting direction of the consumable cartridge is equal to or less than a width of the consumable cartridge in the direction perpendicular to the mounting direction of the consumable cartridge.

17. A consumable cartridge, comprising:

a body;

a coupling disposed on a first side of the body to receive a driving force from a driving source of the image forming apparatus when the consumable cartridge is mounted on a tray disposed inside of the image forming apparatus; and a guide member, formed on a second side of the body opposite to the first side of the body and being downwardly inclined in a direction toward the first side of the body, to move the consumable cartridge in a direction perpendicular to a mounting direction of the consumable cartridge during mounting of the consumable cartridge on the tray so that the consumable cartridge is mounted on the tray.

18. The consumable cartridge of claim 17, further comprising a further coupling, disposed on the first side of the body and above the coupling in a vertical direction of the consumable cartridge, to receive a driving force when the consumable cartridge is mounted on the tray disposed inside of the image forming apparatus.

19. The consumable cartridge of claim 18, further comprising:

a photosensitive drum; and a developing roller, wherein the coupling is a photosensitive drum driving coupling to drive the photosensitive drum, and the further coupling is a developing roller driving coupling to drive the developing roller.

* * * * *